United States Patent [19]

Blachford

[11] 4,106,932

[45] Aug. 15, 1978

[54] LUBRICANTS FOR POWDERED METALS, AND POWDERED METAL COMPOSITIONS CONTAINING SAID LUBRICANTS

[75] Inventor: John Blachford, Westmount, Canada

[73] Assignee: H. L. Blachford Limited, Montreal, Canada

[21] Appl. No.: 749,699

[22] Filed: Dec. 10, 1976

Related U.S. Application Data

[63] Continuation-in-part of Ser. No. 600,777, Jul. 31, 1975, Pat. No. 4,002,474.

[30] Foreign Application Priority Data

Jul. 31, 1974 [CA] Canada ..... 206086

[51] Int. Cl.[2] ..... B22F 1/00; B01J 13/02; C10M 5/14; C10M 5/20

[52] U.S. Cl. ..... 75/252; 75/211; 75/214; 252/10; 252/56 S; 252/316; 264/111

[58] Field of Search ..... 252/10, 316, 56 S; 29/192 R; 264/111; 75/251, 252

[56] References Cited

U.S. PATENT DOCUMENTS

| | | | |
|---|---|---|---|
| 2,757,139 | 7/1956 | Matuszak et al. | 252/56 S |
| 2,900,342 | 8/1959 | Manteuffel et al. | 252/56 S X |
| 3,513,943 | 5/1970 | Ernst et al. | 252/10 X |
| 3,539,472 | 11/1970 | Findeisen et al. | 264/111 X |
| 3,577,515 | 5/1971 | Vandegaer | 252/316 X |
| 3,728,110 | 4/1973 | Klar et al. | 29/192 R X |
| 3,743,604 | 7/1973 | Schnoring et al. | 252/316 |
| 3,985,840 | 10/1976 | Hofacker | 252/316 X |

FOREIGN PATENT DOCUMENTS

| | | | |
|---|---|---|---|
| 2,238,604 | 2/1974 | Fed. Rep. of Germany | 252/10 |

OTHER PUBLICATIONS

Dombrow: "Polyurethanes," Reinhold Plastics Applications Series, 1st Edit., 1957, Reinhold Publ. Corp., New York, p. 17.

*Primary Examiner*—Richard D. Lovering
*Attorney, Agent, or Firm*—Bacon & Thomas

[57] ABSTRACT

Discrete pressure-rupturable microcapsules for lubrication in powder metallurgy are disclosed comprising a core and a solid shell surrounding said core; the core comprises an organic liquid lubricant able to wet powdered metals, the shell comprises a thin non-atmospherically degradable polymeric material; the microcapsules may be used as the sole lubricant in the manufacture of sintered metal parts or may be used in admixture with unencapsulated solid lubricants to produce synergistic free-flowing compositions; there are also provided novel compositions of matter for forming sintered metal components comprising a mixture of sinterable, powdered metal and the microcapsules.

31 Claims, 4 Drawing Figures

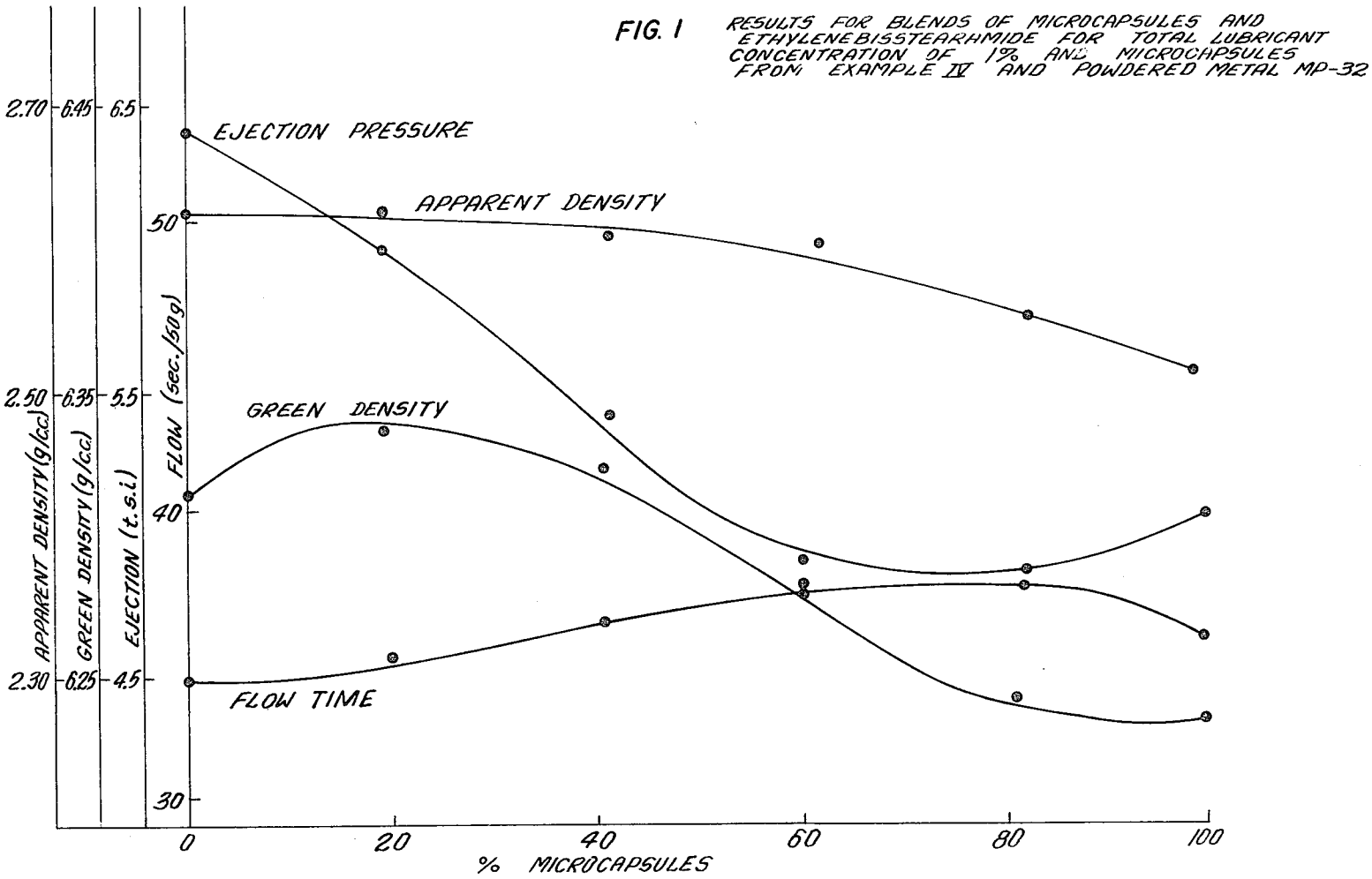
FIG. 1 RESULTS FOR BLENDS OF MICROCAPSULES AND ETHYLENEBISSTEARAMIDE FOR TOTAL LUBRICANT CONCENTRATION OF 1% AND MICROCAPSULES FROM EXAMPLE IV AND POWDERED METAL MP-32

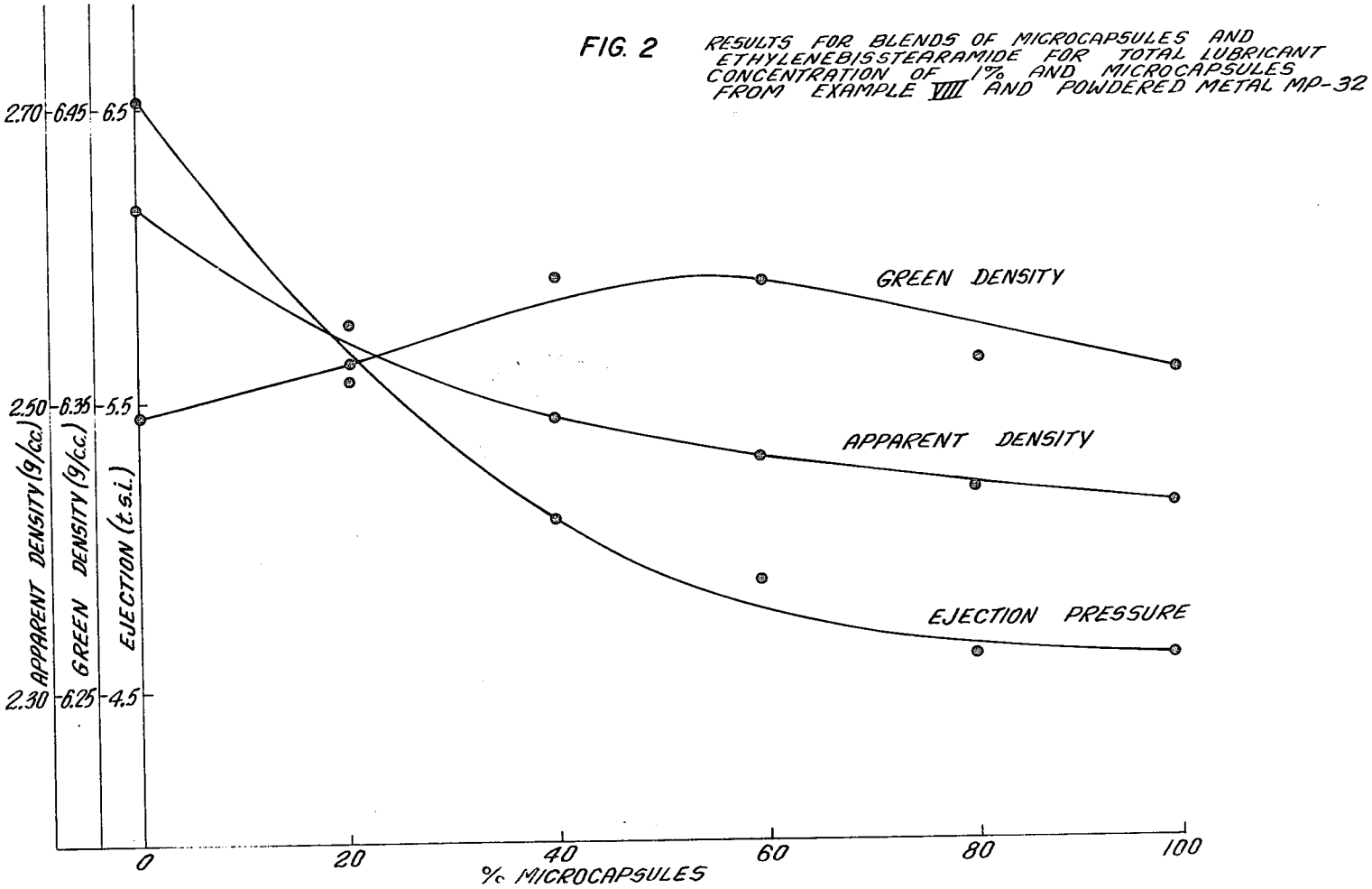
FIG. 2 RESULTS FOR BLENDS OF MICROCAPSULES AND ETHYLENEBISSTEARAMIDE FOR TOTAL LUBRICANT CONCENTRATION OF 1% AND MICROCAPSULES FROM EXAMPLE VIII AND POWDERED METAL MP-32

FIG. 3 RESULTS FOR BLENDS OF MICROCAPSULES AND ETHYLENEBISSTEARAMIDE FOR TOTAL LUBRICANT CONCENTRATION OF 1% AND MICROCAPSULES FROM EXAMPLE X AND POWDERED METAL ATOMET 29
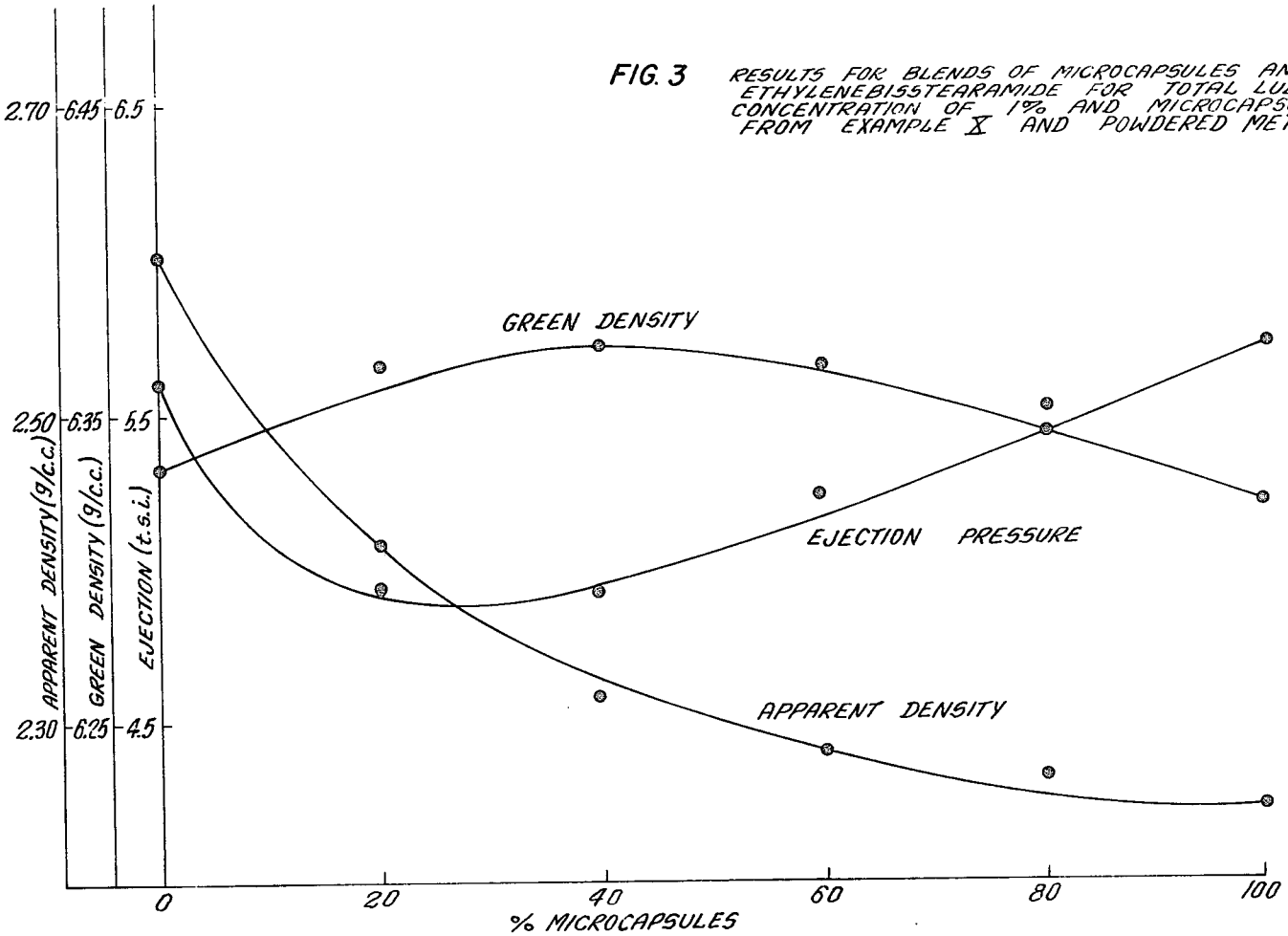

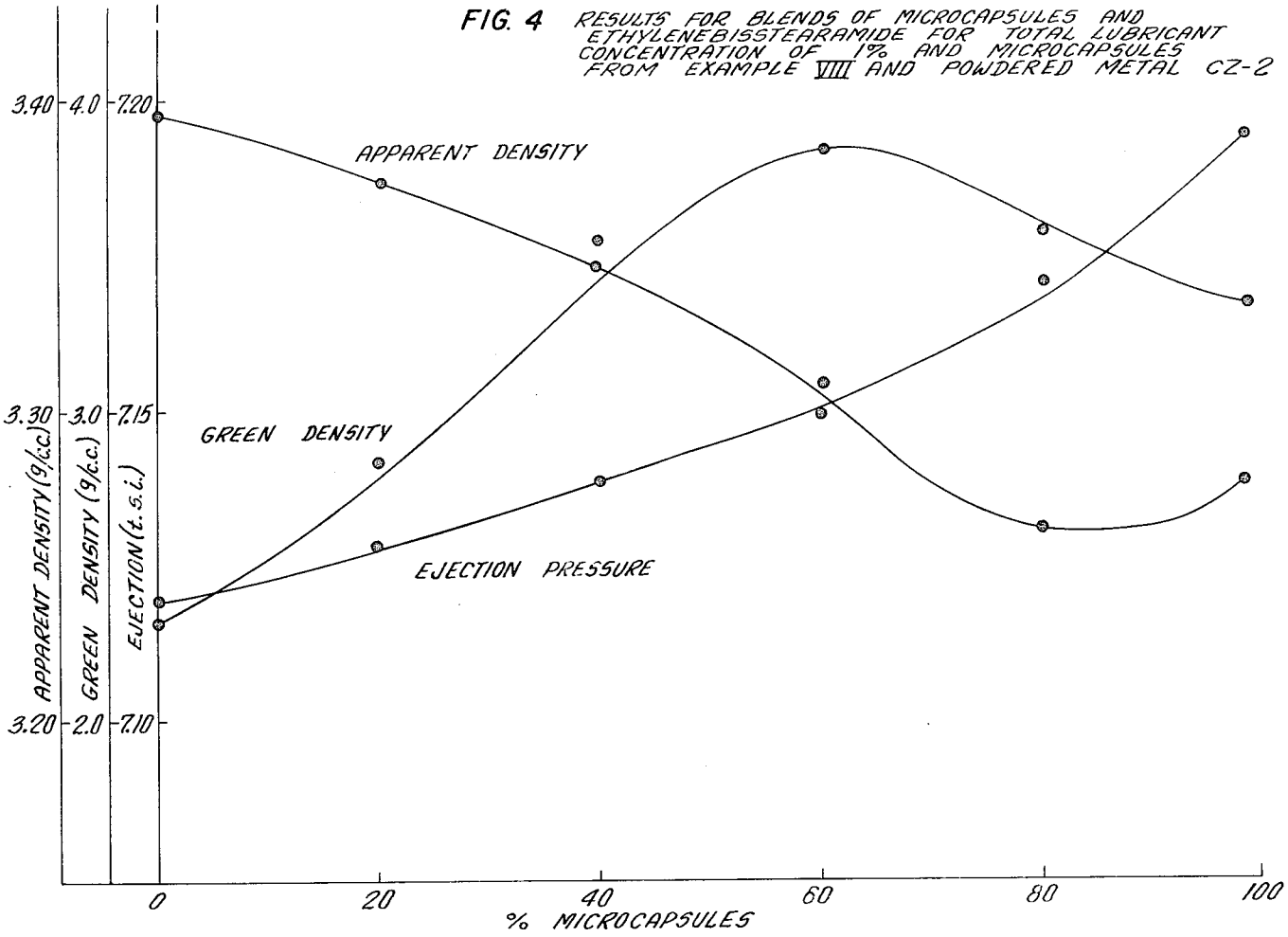
FIG. 4 RESULTS FOR BLENDS OF MICROCAPSULES AND ETHYLENEBISSTEARAMIDE FOR TOTAL LUBRICANT CONCENTRATION OF 1% AND MICROCAPSULES FROM EXAMPLE VIII AND POWDERED METAL CZ-2

LUBRICANTS FOR POWDERED METALS, AND POWDERED METAL COMPOSITIONS CONTAINING SAID LUBRICANTS

CROSS-REFERENCE TO RELATED APPLICATION

This application is a continuation-in-part of U.S. patent application, Ser. No. 600,777, filed July 31, 1975, now U.S. Pat. No. 4,002,474.

BACKGROUND OF THE INVENTION (a) Field of the Invention

This invention relates to lubricants for powder metallurgy and to the manufacture and use of lubricants.

More particularly the lubricant comprises a microcapsule comprising a core of a liquid lubricant enclosed by a solid shell.

(b) Description of Prior Art

Powdered metals, for example, powdered iron, are used to make small, fairly intricate parts, for example, gears. The fabrication of such metallic parts by powdered metal technology involves the following steps:

(a) the powdered metal is blended with a lubricant and other additives to form a mixture, (b) the mixture is poured into a mould, (c) the mixture is compacted in the mould to form a part using a high pressure, usually of the order of 30 tons per square inch, (d) after compaction the part is ejected from the mould, (e) the ejected part is subjected to a high temperature to decompose and remove the lubricant, (f) the part is heated to a higher temperature to cause all the particles of metal in the part to sinter together and (g) the part is cooled, after which it is ready for use.

Commonly used lubricants include zinc stearate and lithium stearate.

The lubricant is added to the powdered metal for several reasons; it increases the bulk density of the uncompacted powdered metal. This means that the moulds can be shallower, for a given thickness of the final part. The bulk density is generally referred to as the "apparent density".

The lubricant allows the compacting pressure to be reduced to attain a specified density before sintering. This is very important because it means that for a given pressure a larger part can be made. Because of the very large pressures required to compact powdered metal, only relatively small parts are made. The density of the compacted part is called the "green density".

The ejection force to remove the compacted part from the mould is much lower when a lubricant is present and this lower force results in less mould wear.

Unfortunately, the lubricant also has a few adverse effects; it often reduces the flow rate of the powdered metal and therefore the rate at which a mould can be filled; it reduces the strength of the compacted part, referred to as the "green strength"; further, it can cause an unattractive surface finish on the sintered part. Zinc stearate is commonly used as a lubricant and slowly deposits a thin coating of zinc and zinc oxide on the walls of the oven used to burn off the lubricant or on the walls of the sintering oven.

This last disadvantage is often serious, and because of it a wax is sometimes used instead of zinc stearate. The most commonly used wax is ethylenebisstearamide; however, it is not as good a lubricant as zinc stearate, especially with regard to compressibility, i.e., it gives a lower green density for a given compacting pressure. It can only provide the same compressibility as zinc stearate if it is ground to a very fine powder using a special grinding mill which is expensive and consumes a great deal of energy.

A further disadvantage to customarily used lubricants is that they are dusty.

SUMMARY OF THE INVENTION

The present invention provides an entirely or almost entirely organic lubricant for powder metallurgy which is comparable to zinc stearate with respect to compressibility of the lubricant-metal mixture, as well as with respect to other properties of the mixture and of parts produced therefrom.

The invention further provides an organic powdered metal lubricant which is cheap, dustless, nontoxic, and which can be used in quantities no greater than now used for existing lubricants, for example, zinc stearate, lithium stearate and waxes.

The invention further provides a lubricant composition which comprises a synergistic mixture of microencapsulated lubricant and unencapsulated solid lubricant.

It has been found that small capsules called microcapsules consisting of a liquid lubricant surrounded by a solid shell material, having certain properties, provide an excellent lubricant for powdered metals.

The addition of a liquid lubricant to powdered metal results in high compressibility and low ejection pressure, however, it also causes very poor flow and very low apparent density which are unacceptable.

When the liquid lubricant is encapsulated, however, according to the present invention, it does not have an opportunity to reduce the flow rate or the apparent density of the powdered metal; however, when the mixture of powdered metal and encapsulated lubricant is subjected to high pressure during the compaction stage, the shell of the capsule is ruptured or broken and the liquid lubricant is released to coat the particles of powdered metal and the die wall, and thereby results in high compressibility and low ejection pressure.

According to one aspect of the invention there is provided discrete pressure-rupturable microcapsules for lubrication in powder metallurgy comprising a core and a solid shell surrounding said core; said core comprising an organic liquid lubricant able to wet powdered metals, and said shell comprising a thin non-atmospherically-degradable polymeric material; said shell being impermeable to said lubricant and having a smooth, outer surface resistant to abrasion by sinterable powdered metal, to the extent that the microcapsules can be thoroughly mixed with sinterable powdered metal without release of lubricant, said shell being rupturable when said microcapsules are in admixture with sinterable powdered metal and are subjected to powder metallurgy compacting pressures; said lubricant and said shell being heat decomposable to gaseous products which are non-corrosive to sinterable metal with a low residue of carbon at elevated temperatures below the sintering temperature of a powdered metal to be sintered.

According to another aspect of the invention there is provided a free-flowing lubricant composition for powder metallurgy lubrication comprising the discrete pressure-rupturable microcapsules defined above in admixture with a solid particulate lubricant, for example, an amide wax or a metal stearate; such mixtures exhibit beneficial synergistic effects.

According to a further aspect of the invention there is provided a novel composition of matter for the manufacture of sintered metal articles comprising a mixture of powdered, sinterable metal and the microcapsules or free-flowing lubricant composition of the invention; the microcapsules or lubricant composition being present in an amount of 0.1% to 5%, by weight, of the composition.

LIQUID LUBRICANT

With regard to the physical properties of the lubricant it should be liquid at the temperature at which it is used; the melting point should be below room temperature, or more precisely, below the temperature of the powdered metal when it is compacted. It should have a low enough viscosity so that when the shell is ruptured the lubricant will rapidly flow out and envelop the particles of powdered metal. The viscosity should be less than 1500 centipoises, preferably less than 600 centipoises and suitably below 300.

The liquid lubricant must have the ability of wetting the powdered metal. This is generally dependent on the surface tension properties and generally if the surface tension of the lubricant is below about 50 and preferably below about 40 dynes/cm., good wetting should occur. The liquid lubricant should not dissolve the shell material or it will tend to slowly diffuse through the shell. Since lubricants are frequently burned off at about 1200° F. prior to sintering, at least 90% of the liquid should volatilize or decompose below the burning-off temperature. The remaining lubricant should completely burn off in the sintering oven so that very little black soot is deposited on the surface of the sintered part.

With regard to chemical properties the liquid lubricant should not be corrosive, and should not yield corrosive degradation products or yield degradation products which adversely affect the lining of the sintering furnace or the properties of the sintered metal parts. These requirements eliminate such lubricants as chlorinated or sulphonated fats and oils.

Liquid lubricants which have been found to be suitable are animal and vegetable fats and oils which have the required low melting points. Examples are rapeseed oil, soya-bean oil, peanut oil and coconut oil. Fatty acids and fatty acid esters are also suitable, provided they have low enough melting points. Examples are: oleic acid; methyl laurate and the methyl ester of lard oil; epoxidized fats and oils which are liquids, such as epoxidized soya-bean oil; fatty acid esters of polyols such as glycerol, trimethylolpropane, pentaerythritol, polyethylene glycols, polypropylene glycols, and copolymers formed by addition of ethylene oxide and propylene oxide to a glycol or amine base. Generally synthetic fatty acid esters or mixtures of synthetic fatty acid esters or mixtures of synthetic and natural fatty acid esters are preferred. Mineral oils and low melting point polyethylene glycols and polypropylene glycols can also be used, but are less preferred.

Small amounts of special additives may be mixed with the liquid lubricant, even though if present in large amounts they would be deleterious. Examples of these are chlorinated oils, sulphonated oils, tricresyl phosphate, zinc dithiodialkylphosphates, antioxidants, and sodium nitrite.

The lubricant may also contain small amounts of solid lubricants, for example, molybdenum disulphide.

The amount of liquid lubricant present in the microcapsules should be as great as possible, because the shell material itself is not a good lubricant. Large amounts may be employed, provided difficulties are not encountered in the formation of a continuous shell and the shell is sufficiently strong. Usually the lubricant content varies between 50% and 90%, preferably 50% to 85%, by weight.

SHELL

The chemical properties required of the shell material are the same as for the liquid lubricant. With regard to physical properties the shell material must satisfy several criteria. The shell should be impermeable to the liquid lubricant. The surface of the shell must be sufficiently smooth so that a good flow rate and apparent density is obtained for the mixture of powdered metal, lubricants and other additives. The flow rate and apparent density should be at least ninety percent of the corresponding values for the powder without lubricant, and should preferably be greater. Neither moisture in the air nor oxygen should degrade the shell.

The shell material should be sufficiently abrasion resistant so that the microcapsules can be thoroughly mixed with the powdered metal without release of the liquid lubricant. During this mixing operation the temperature may reach as high as 130° F. and therefore the shell should be able to withstand this temperature. A further and rather obvious requirement, is that the shell should rupture when subjected to the pressure exerted during compaction. This pressure can range from as low as one t.s.i. (tons per square inch) to as high as one hundred t.s.i. For iron and steel pressures of 20–60 t.s.i. are most commonly used, while for brass and bronze somewhat lower pressures are generally used, and for aluminum the usual range is 10–20 t.s.i It is also desirable that the shell material be such that thin shells can be utilized so that the percentage of liquid lubricant is high. Shell thickness is usually in the range 0.01 to 50 microns, preferably 0.1 to 20 microns, depending on capsule size.

MICROCAPSULE

The size, shape and colour of the microcapsules are important. If the microcapsules are too large they will segregate from the powdered metal. If all of the microcapsules pass through a 140 mesh sieve there is no danger of segregation with commonly used metal powders. Fine capsules are not always preferable since they fit more easily into interstices between the metal particles and a greater degree of compaction is required before they break. Also, in capsules prepared by the interfacial method, the wall thickness is proportional to the capsule diameter, so smaller capsules are less resistant to abrasion.

Coarser microcapsules frequently lead to lower apparent densities and lower green densities. However, they also lead to higher flow rates; therefore, when a high flow rate is paramount, coarse particles should be used, for example, 50 microns in diameter. Generally the microcapsule will have a size in the range of about 1 to 200, particularly 5 to 100, microns, however, the most suitable microcapsule size is also dependent on the particular grade of iron or non-ferrous metal powder.

A spherical shape is the most desirable, because this leads to the highest flow rate and apparent density. A black or grey colour is undesirable, particularly when the powdered metal is iron powder, because it is then impossible to determine whether the microcapsules have been thoroughly mixed with the powdered metal; white is the preferred colour.

In one embodiment of the invention the shell of the microcapsules is coated with a thin layer of a solid which is a good lubricant for powdered metals, for example, stearic acid or carnauba wax. This coating can result in an improvement in the apparent density and flow rate, without harming the other properties. Preferably, the coating constitutes between 5 and 15% of the total weight of the microcapsules. If it is much less, the coating will not completely cover the shell; if it is much more, the beneficial effects of the encapsulated liquid lubricant will be reduced.

In another embodiment of the invention the microencapsulated lubricant is mixed with an unencapsulated solid particulate lubricant because synergism occurs with respect to certain properties; for example, the compressibility may reach a maximum at a particular concentration of microcapsules, and the ejection force may reach a minimum at another, usually different, concentration of microcapsules; the values of these concentrations depend upon the particle size and the composition of the microcapsules and of the unencapsulated solid particulate lubricant. The compositions giving optimum properties can vary over a wide range, depending on the property considered and the powder used, but usually the microcapsule content is from 1 to 99, preferably 5 to 95 percent.

Suitable solid particulate lubricants include waxes (for example, ethylenebisstearamide wax, Carnauba wax, Fischer-Tropsch wax) fatty acids, zinc stearate and lithium stearate.

MICROCAPSULE PRODUCTION

There are several methods of microencapsulating a liquid and most of these can be applied to the microencapsulation of liquid lubricants. U.S. Pat. Nos. 2,800,457, 3,041,288 and 3,201,353 involve the formation of a shell by the precipitation of gelatin; in U.S. Pat. No. 3,137,631 other proteins are used to form the shell. Precipitation of synthetic polymers is employed in U.S. Pat. No. 3,173,878 to produce a shell. U.S. Pat. No. 2,969,330 entails shell formation by the polymerization of a monomer at the interface of the oil and water in which the oil is emulsified. In U.S. Pat. No. 3,796,669 the shell formation is by the copolymerization of two monomers in an emulsion of an oil and water.

Although encapsulation methods using gelatin are the most popular and have been thoroughly investigated they are not particularly suitable for the present application because, in addition to other reasons, the gelatin shells are moisture sensitive and the surfaces are often tacky; a tacky surface causes low flow rates and low apparent densities.

U.K. Pat. No. 950,443 and U.S. Pat. No. 3,577,515 involve a method which is similar to that preferred in the present invention. In this case, microcapsules are formed by a condensation polymerization reaction between a monomer which is soluble in a water phase and a monomer soluble in a water immiscible phase.

The microcapsules may be manufactured by a method comprising the following steps: (1) If necessary, mix an emulsifying agent with either the liquid lubricant, the water phase, or both. (2) Mix a lubricant soluble monomer with the liquid lubricant. (3) Add the resulting mixture to the water phase. (4) Mix at room temperature using vigorous agitation to form an emulsion of the desired droplet size, as discussed above. (5) To the emulsion add, with mixing, a water soluble monomer reactive with the lubricant soluble monomer or a polymerization catalyst for the lubricant soluble monomer. (6) Mix, but not so vigourously that the capsules are destroyed, for several hours, with heating to about 80° C. if desired, to accelerate the reaction. (7) Filter the mixture to separate the microcapsules from the water. (8) Wash the microcapsules to remove emulsifying agent and any excess water soluble monomer and (9) dry the microcapsules.

The liquid lubricant should, of course, be inert to and not interfere with the polymerization. In this respect fatty acids should be avoided as the liquid lubricant when the isocyanate/amine reaction is employed because the fatty acids and amines tend to react together preventing or hindering the formation of microcapsules, and the fatty acid can also react with the isocyanate.

To coat the microcapsules with a thin layer of a solid lubricant, the mass of dried microcapsules is heated to a temperature a little above the melting point of the solid lubricant; the solid lubricant is then added, preferably as a fine powder, and the mixture is mixed gently for about an hour while the temperature is held constant. Finally, with continuous mixing, the temperature is allowed to slowly decrease to that of the room. It is generally found that several aggregates of microcapsules have formed during this process because of the bonding nature of the solid lubricant. These can easily and completely be broken by grinding lightly in a hammer mill.

In the preferred method a di- or polyfunctional isocyanate is dissolved in the liquid lubricant; the resulting solution is emulsified in water containing an appropriate emulsifying agent, and an aqueous solution of a di- or poly-functional amine is added. Among the isocyanates that can be used there may be mentioned:

toluene diisocyanate
dianisidine diisocyanate
xylylene diisocyanate
bitolylene diisocyanate
hexamethylene diisocyanate
o,m and p-phenylene diisocyanate
methylene bisphenylisocyanate
polymethylene polyphenylisocyanate
1,6-hexamethylene diisocyanate
methylcyclohexylene diisocyanate
trimethylhexamethylene diisocyanate Examples of amines that can be used in the method are the following:

ethylene diamine
methane diamine
1,3-diaminocyclohexane
m-xylylenediamine
diethylenetriamine
iminobispropylamine
propylenediamine
triethylenetetramine
tetraethylenepentamine
m-phenylenediamine
4,4'-methylenedianiline Examples of liquid lubricants which can be used in the preferred encapsulation method are as follows:

rapeseed oil
soyabean oil epoxidized soyabean oil
methyl lardate
methyl laurate
peanut oil
methyl oleate
corn oil
polyethylene glycol dioleate

PRODUCTION OF SINTERED METAL ARTICLE

The microcapsules of the invention or mixtures of the microcapsules with solid particulate lubricants are advantageously employed in the manufacture of sintered metal articles from powdered metal.

In this method the powdered metal is mixed or blended with the microcapsules, or a mixture of the microcapsules with a conventional solid particulate lubricant, to form an intimate mixture.

The mixture is compacted in a mould at a pressure effective to rupture the shell of the microcapsules and release the liquid lubricant, and to form the mixture into a self-supporting shaped body. The compacting pressure will depend too on the particular metal powder and may be from 1 t.s.i. to 100 t.s.i.; generally compacting pressures of 10 t.s.i. to 75 t.s.i. will be satisfactory.

The self-supporting body is removed from the mould and is heated to decompose and remove the lubricant and shell and to sinter the metal particles. This heating operation may take place in two separate stages most of the lubricant and shell and any solid particulate lubricant being removed in a first heating stage and any residual material subsequently being removed in the sintering furnace. The lubricant and shell could be removed entirely in the sintering furnace but this results in deposits on the interior of the sintering furnace which may serve to decrease the efficiency of the furnace over a period of time.

When mixed with metal powders, the concentration of the microcapsules or of microcapsules plus unencapsulated solid lubricants, is suitably in the range of 0.1 to 5% by weight, preferably from 0.3 to 1% by weight.

The method can be employed in the manufacture of sintered metal parts from a variety of powdered sinterable metals including ferrous metals, for example, iron and steel and non-ferrous metals, for example, aluminium, copper and zinc, as well as mixtures of metal powders, for example mixtures of iron and copper, and powdered alloys, for example, brass powder. It will be understood that such sinterable metal powders may also include conventional additives, for example, graphite which is often employed in admixture with iron.

The microcapsules may also be employed in the manufacture of sintered parts from sinterable metal oxides, and sinterable metal salts, for example, uranium oxide and barium ferrite.

BRIEF DESCRIPTION OF DRAWINGS

Test data on lubricant compositions of the invention are illustrated with reference to the accompanying drawings in which:

FIG. 1 shows graphically the variation in flow time, green density, apparent density and ejection pressure for iron powder (MP-32, trademark) containing 1% by weight of lubricant comprising microcapsules admixed with particulate ethylenebisstearamide, with microcapsule concentration, for the microcapsule of Example IV.

FIG. 2 shows graphically the variations in ejection pressure, apparent density and green density for iron powder (MP-32 trademark) containing 1% by weight of lubricant comprising microcapsules admixed with ethylenebisstearamide, with microcapsule concentration, for the microcapsules of Example VIII.

FIG. 3 shows graphically the variation in ejection pressure, apparent density and green density for iron powder (Atomet 29, trademark) containing 1% by weight of lubricant comprising microcapsules admixed with ethylenebisstearamide, with microcapsule concentration, for the microcapsules of Example X, and FIG. 4 shows graphically the variation in ejection pressure, apparent density and green density for brass powder (CZ-2, trademark) containing 1% by weight of lubricant comprising microcapsules admixed with ethylenebisstearamide, with microcapsule concentration, for the microcapsules of Example VIII.

DESCRIPTION OF PREFERRED EMBODIMENTS

The following examples serve to illustrate the invention, but they are not intended to limit it thereto.

EXAMPLE I

Rapeseed oil encapsulated in the reaction product from ethylene diamine and toluene diisocyanate 30 g. of toluene diisocyanate (Nacconate 80, trademark from Allied Chemical) was dissolved in 120 g. of refined rapeseed oil. The solution was added with stirring to a solution of 3 g. of Siponic 218 (trademark for a polyoxyethylene thioether from Alcolac, Inc.) in 700 g. of water. When the emulsification was complete, the stirring rate was reduced and 30 g. of ethylene diamine dissolved in 70 g. of water was added. The temperature was then increased to 80° C. and maintained constant while the mixture was stirred for 4 hours.

The resulting dispersion of microcapsules in water was filtered and the microcapsules dried at 60° C. Aggregates of microcapsules were broken by light grinding through a hammer mill.

The microcapsules were white, spherical, free flowing, had an average particle size of about 50 microns and contained about 66% by weight of rapeseed oil.

EXAMPLE II

Methyl oleate encapsulated in the reaction product from ethylene diamine and toluene diisocyanate 30 g. of toluene diisocyanate was dissolved in 120 g. of methyl oleate. This solution was added with stirring to a solution of 3 g. of Siponic 218 (trademark) in 700 g. of water. When the emulsification was complete the stirring rate was reduced and 30 g. of ethylene diamine dissolved in 70 g. of water added. The temperature was increased to 80° C. and maintained constant while the mixture was stirred for 4 hours.

The microcapsules were separated from the water by filtration and then dried at 60° C. Aggregates of dried microcapsules were broken by light grinding with a hammer mill.

The microcapsules were white, spherical, free flowing, had an average particle size of about 50 microns, and contained about 66% by weight methyl oleate.

EXAMPLE III

Testing of Microcapsules prepared in Examples I and II

The microcapsules prepared in Examples I and II were tested as lubricants for two different powdered metals using the following formulations:

| Formulation A | | Formulation B | |
|---|---|---|---|
| Iron Powder (QMP's Atomet 29*) | 95.10% | Iron Powder (Domtar's MP32*) | 96.28% |
| Graphite (Southwestern's 1845*) | 0.94% | Graphite (Southwestern's 1845*) | 0.99% |
| Copper (Alcan's MD151*) | 2.960% | Copper (Alcan's MD151*) | 1.98% |
| Lubricant | 1.00% | Lubricant | 0.75% |

Standard test methods were used to determine the effects of the lubricant, namely apparent density by ASTM B212-48, compressibility by ASTM B331-64, green strength by ASTM B312-64, transverse rupture strength by ASTM B528-70 and tensile strength by ASTM E8.

A compacting pressure of 27.5 tons/sq.in. was used to prepare specimens of Formulation A for tensile strength determinations and of 30 tons/sq.in. for transverse rupture. A compacting pressure of 25 tons/sq.in. was used to prepare specimens of Formulation B for tensile and transverse rupture strength determinations.

Following compaction the samples were subjected to 1000° F. in a pure hydrogen atmosphere for 20 minutes to burn off the lubricant, and subsequently to 2050° F. for 30 minutes to sinter the metal.

Tables I and II present the results, along with the corresponding results for two commercially used lubricants, zinc stearate and ethylenebisstearamide wax. It can be seen that compared to the stearate and the wax the use of microcapsules leads to much lower ejection force, to lower apparent density and to greater shrinkage. With regard to the other parameters the results are comparable. A high shrinkage is frequently desirable, and although the tensile strength obtained using encapsulated rapeseed oil is low, it is still acceptable.

TABLE I

Comparison Between Effects of Standard Lubricants and Microcapsule Lubricants for Formulation A

| | Zinc Stearate | Ethylene-bisstear-amide wax | Microcapsules from Example I | Microcapsules from Example II |
|---|---|---|---|---|
| Apparent Density in g/cc | 3.08 | 2.66 | 2.30 | 2.37 |
| Ejection Force in t.s.i. | 4.2 | 4.9 | 4.2 | 4.0 |
| Green Density in g/cc | 6.57 | 6.53 | 6.49 | 6.49 |
| Shrinkage in in./in. $\times 10^{-4}$ | | | | |
| Length | 7 | 13 | 24 | 39 |
| Width | 6 | 10 | 24 | 36 |
| Thickness | 29 | 26 | 55 | 93 |
| Tensile Strength in p.s.i. | 54,140 | 61,050 | 57,000 | 56,390 |
| Transverse Rupture Strength in p.s.i. | 111,130 | 111,180 | 111,080 | 121,230 |

TABLE II

Comparison Between Effects of Standard Lubricants and Microcapsule Lubricants for Formulation B

| | Zinc Stearate | Ethylene-bisstear-amide wax | Microcapsules from Example I | Microcapsules from Example II |
|---|---|---|---|---|
| Apparent Density in g/cc | 2.73 | 2.57 | 2.15 | 2.25 |
| Ejection Force in t.s.i. | 4.3 | 4.8 | 3.2 | 3.6 |
| Green Density in g/cc | 6.35 | 6.30 | 6.30 | 6.28 |
| Shrinkages in in./in. $\times 10^{-4}$ | | | | |
| Length | 20 | 6 | 6 | 16 |
| Width | 12 | 6 | 4 | 14 |
| Thickness | 23 | 13 | 43 | 60 |
| Tensile Strength in p.s.i. | 37,890 | 37,260 | 28,640 | 37,730 |
| Transverse Rupture Strength in p.s.i. | 77,410 | 80,360 | 74,930 | 79,290 |

EXAMPLE IV

Soyabean oil encapsulated in the reaction product from Ethylenediamine and toluene diisocyanate 30 g. of toluene diisocyanate was dissolved in 60 g. of soyabean oil (from Canlin Limited). This solution was added with stirring to a solution of 3 g. of Siponic 218 (trademark) in 700 g. of water. When the emulsification was complete, the stirring rate was reduced and 30 g. of ethylene diamine dissolved in 70 g. of water was added. The temperature was then increased to 80° C. and maintained constant while the mixture was stirred for 4 hours.

The microcapsules were separated from the water by filtration and then dried at 60° C. Aggregates of dried microcapsules were broken by lightly grinding in a hammer mill.

The microcapsules were white, spherical, free flowing had an average diameter of 50 microns, and contained about 50% by weight soyabean oil.

EXAMPLE V

Soyabean oil encapsulated in the reaction product from ethylene diamine and toluene diisocyanate The same procedure was followed as in Example IV except that more soyabean oil was added so that the microcapsules contained about 75% by weight oil.

EXAMPLE VI

Effect of mixtures of ethylenebisstearamide wax and microcapsules from Examples IV and V on Iron Powder Rather than using only microcapsules as a lubricant for powdered metals, blends of microcapsules with customary lubricants can be used. FIG. 1 gives the results for blends of ethylenebisstearamide wax (from H. L. Blachford, Limited) with microcapsules from Example IV where the total concentration of lubricant system is kept constant at 1% and the powdered metal is iron powder MP-32 (trademark) from Domtar. It is surprising to see that the curve for green density shows a maximum, which occurs at approximately 20% microcapsule content. Similarly, the curve for ejection force shows a minimum, which occurs at approximately 75% microcapsule content. These two separate synergistic effects are beneficial, because a high green density and a low ejection force are desirable.

Blends were also prepared using microcapsules from Example V to determine the effect of increasing the oil content from 50% to 75% by weight. Although the results are not shown in FIG. 1, it was found that with the microcapsules containing more oil the apparent densities, flow rates, and ejection pressures were lower, but, the green densities were higher.

EXAMPLE VII

Soyabean oil encapsulated in the reaction product from ethylene diamine and toluene diisocyanate The same procedure was followed as in Example IV except that the amount of soyabean oil was increased to 120 g. so that the microcapsules contained about 66% by weight oil.

EXAMPLE VIII

Soyabean oil encapsulated in the reaction product from ethylene diamine and toluene diisocyanate 30 g. of toluene diisocyanate was dissolved in 120 g. of soyabean oil. The solution was added with stirring to a solution of 3 g. of Siponic 218 (trademark) in 700 g. of water. The resulting coarse emulsion was then mixed very vigorously in a high intensity colloid mill to produce an emulsion containing very fine droplets of oil. The stirring rate was then reduced and 30 g. of ethylene diamine in 70 g. of water was added. The temperature was then increased to 80° C. and maintained constant while the mixture was stirred for 4 hours.

The microcapsules were separated from the water by filtration and dried at 60° C. Aggregates of dried microcapsules were broken by gentle grinding.

The microcapsules were white, spherical, free flowing, had an average diameter of 5 microns and contained about 66% by weight oil.

EXAMPLE IX

Effect of mixtures of ethylenebisstearamide wax and microcapsules from Examples VII and VIII on iron powder Rather than using only microcapsules as a lubricant for powdered metals, blends of microcapsules with customary lubricants can be employed. FIG. 2 gives the results for blends of ethylenebisstearamide wax with the fine particle size capsules from Example VIII. The total concentration of lubricant was held at 1% and the powdered metal was iron powder MP-32 (trademark) from Domtar. It is surprising to see that the curve for green density shows a maximum, which occurs at microcapsule content of approximately 50% by weight. The results show that synergism occurs between the two different kinds of lubricant.

Blends were also prepared and tested using microcapsules from Example VII to determine the effect of microcapsule particule size. Although the results are not shown, it was found that using the coarser microcapsules resulted in a maximum in the green density, but it occurred at around 30% by weight microcapsule content, rather than 50% by weight as with the finer microcapsules. Furthermore, the apparent densities were lower. The ejection pressures were lower at low concentrations of microcapsules, but higher at high concentrations.

EXAMPLE X

Rapeseed oil encapsulated in the reaction product from ethylene diamine and toluene diisocyanate The same procedure was used as in Example VIII, except that rapeseed oil was used in place of soyabean oil. The microcapsules formed had an average diameter of approximately 5 microns and contained 66% by weight oil.

EXAMPLE XI

Effect of Mixtures of ethylenebisstearamide wax and microcapsules from Examples I and X on iron powder Blends of microcapsules and a conventional lubricant were prepared and tested in iron powder Atomet 29 (trademark), for Quebec Metal Powder Company. FIG. 3 gives the results for blends of ethylenebisstearamide wax with the fine particle size capsules from Example X. The total concentration of lubricant was kept constant at 1% by weight. The results are similar to those given in Examples VI and VIII. A maximum green density occurs at a microcapsule concentration of approximately 40% by weight. As in Example VI there is a minimum in the curve for ejection pressure. Beneficial synergism occurs here also, with regard to both green density and ejection pressure.

Blends were also prepared and tested using microcapsules from Example I. These capsules are identical to those from Example X, except that they are much larger. Although the results are not shown, it was found that the green density reaches a maximum at a lower microcapsule concentration. The ejection pressures and apparent densities are higher.

EXAMPLE XII

Coating of microcapsules from Example VIII with thin layers of lubricants

A 166 g. sample of fine microcapsules from Example VIII was heated to 150° F. and to half of this was added, with mixing, 17 g. of double pressed stearic acid and to the other half was added, with mixing, 17 g. of a Fischer Tropsch Wax (Paraflint — trademark). The samples were held at 150° F. and mixed for 30 minutes. The heat source was then removed and the samples allowed to cool to room temperature, at which point the mixing was stopped. The aggregates that had formed as a result of this treatment were broken by light grinding.

The coated microcapsules were tested as lubricants for iron powder, Atomet 29 (trademark) using a lubricant concentration of 0.75% by weight.

TABLE III

Effect of Thin Coating on Lubricant Properties

| | Zinc Stearate | Ethylene-bisstear-amide | Uncoated Capsules | Coated Capsules: Stearic Acid | Coated Capsules: Wax |
|---|---|---|---|---|---|
| Flow Rate in sec./50 g. | 34.5 | 41.0 | no flow | no flow | no flow |
| Apparent Density in g./cc | 3.24 | 2.94 | 2.58 | 2.95 | 2.66 |
| Green Density in g./cc | 6.60 | 6.55 | 6.55 | 6.60 | 6.52 |
| Ejection Force in t.s.i. | 5.4 | 6.4 | 5.6 | 4.9 | 5.7 |

TABLE III-continued

| Effect of Thin Coating on Lubricant Properties | | | | | |
|---|---|---|---|---|---|
| | | | | Coated Capsules | |
| | Zinc Stearate | Ethylene-bisstear-amide | Uncoated Capsules | Stearic Acid | Wax |
| Green Strength in p.s.i. | 1664 | 2218 | 1437 | 1175 | 1423 |

The results show that the stearic acid coated microcapsules give higher apparent densities and green densities than do the uncoated.

EXAMPLE XIII

Coating of microcapsules from Example VII with thin layers of lubricants

Four samples, each weighing 83 g., of coarse microcapsules from Example VII were heated to 150° F. and to each was added 17 g. of a coating material. Four materials were used: double pressed stearic acid, Fischer Tropsch Wax, hydrogenated castor fatty acid and Carnauba wax. The samples were held at 150° F. and mixed for 30 minutes. They were then allowed to cool at room temperature with constant mixing. Any aggregates of coated microcapsules that had formed were broken by light grinding.

The coated microcapsules were tested as lubricants for iron powder Atomet 29 (trademark) using concentrations of 0.50 and 0.75% by weight. Table IV presents the results along with those for customarily used lubricants.

The results show that when coarse microcapsules are coated there is a spectacular improvement in the flow rate and apparent density. Although no results are shown, it was found that coating the capsules increased the green strength, but had no significant effect on other properties.

TABLE IV

| Effect of Various Coatings on Lubricant Properties | | | |
|---|---|---|---|
| | Concentration of Lubricant | Flow Rate in sec./50 G. | Apparent Density in G./cc. |
| Ethylene Bisstear-amide | 0.50% | 32.0 | 2.73 |
| | 0.75% | 35.0 | 2.62 |
| Uncoated Micro-capsules | 0.50% | no flow | 2.38 |
| | 0.75% | no flow | — |
| Stearic Acid Coated Capsules | 0.50% | 39.5 | 2.71 |
| | 0.75% | 37.5 | 2.67 |
| Fischer Tropsch Wax Coated Capsules | 0.50% | 30.5 | 2.61 |
| | 0.75% | 35.0 | 2.54 |
| Castor Fatty Acid Coated Capsules | 0.50% | — | — |
| | 0.75% | 38.5 | 2.60 |
| Carnauba Wax Coated | 0.50% | — | — |
| | 0.75% | 37.0 | 2.61 |

EXAMPLE XIV

Methyl Lardate encapsulated in the reaction product from Ethylene Diamine and Trimethyl Hexamethylene Diisocyanate 30 g. of trimethyl hexamethylene diisocyanate was dissolved in 120 g. of methyl lardate. This solution was added with stirring to a solution of 3 g. of Siponic 218 (trademark) in 700 g. of water. When the emulsification was complete, the stirring rate was reduced and 30 g. of ethylene diamine dissolved in 70 g. of water was added. The temperature was then increased to 80° C. and maintained constant while the mixture was stirred for 4 hours.

The resulting dispersion of microcapsules in water was filtered and the microcapsules dried at 60° C. Aggregates of microcapsules were broken by light grinding.

The microcapsules were white, spherical, free flowing, had an average particle size of 50 microns and contained approximately 66% by weight methyl lardate.

EXAMPLE XV

Methyl lardate encapsulated in the reaction product from propylenediamine and trimethyl hexamethylene diisocyanate The same procedure was followed as in Example XIV except that 32 g. of propylene diamine were used instead of 30 g. of ethylenediamine.

The resulting microcapsules were white, spherical, free flowing, had an average particle size of 50 microns and contained approximately 66% methyl lardate.

EXAMPLE XVI

Rapeseed oil encapsulated in polymerized divinylbenzene 25 g. of divinylbenzene were dissolved in 60 g. of rapeseed oil. This solution was added with vigorous stirring to a solution of 0.5 g. of Siponic 218 in 700 g. of water. When the emulsification was complete, the stirring rate was reduced and the temperature raised to 80° C. Then, 2 g. of potassium persulphate were added and the mixture stirred at 80° C. for 6 hours. The temperature was allowed to drop to 25° C. At this point, the mixture was filtered, and the microcapsules washed and then dried at 45° C. The dried capsules were gently ground to break any aggregates.

The final microcapsules were white, spherical, free flowing, had an average particle size of 20 microns and contained approximately 70% by weight rapeseed oil.

EXAMPLE XVII

Isostearic acid encapsulated in polymerized divinylbenzene

The same procedure was followed as in Example XVI, except that 60 g. of isostearic acid was used instead of 60 g. of rapeseed oil.

The resulting microcapsules were white, spherical, free flowing, had an average particle size of 20 microns and contained approximately 70% by weight isostearic acid.

EXAMPLE XVIII

Effect of mixtures of ethylenebisstearamide wax and microcapsules from Example VIII on brass powder Blends of microcapsules and a conventional lubricant were prepared and tested using CZ-2 (trademark) brass powder (from Canada Metals Limited). FIG. 4 gives the results for blends of ethylenebisstearamide wax with the fine particle size microcapsules prepared in Example VIII. The total concentration of lubricant was held constant at 1% by weight. Here again synergism occurs and there is a maximum in the green density, which in this case occurs at a concentration of microcapsules of approximately 60% by weight. In contrast to the results for iron powders, the ejection pressure increases with the addition of microcapsules.

EXAMPLE XIX

Epoxidized soyabean oil encapsulated in the reaction product from ethylene diamine and polymethylene polyphenylisocyanate 13.5 g. of polymethylene polyphenylisocyanate (Mondur MRS, trademark from Mobay Chemical Company) was dissolved in 76.5 g. of epoxidized soyabean oil (Paraplex G-62, trademark from Rohm and Haas). The solution was added with stirring to a solution of 3 g. of Siponic 218 (trademark) in 700 g. of water. The resulting coarse emulsion was then mixed very vigorously in a high intensity colloid mill to produce an emulsion containing very fine droplets of oil. The stirring rate was then reduced and 3.5 g. of ethylene diamine in 10 g. of water was added. The temperature was then increased to 80° C. and maintained constant while the mixture was stirred for 4 hours.

The microcapsules were separated from the water by filtration and dried at 60° C. Aggregates of dried microcapsules were broken by gentle grinding.

The microcapsules were white, spherical, free flowing, had an average diameter of 5 microns and contained 85% oil. When tested as lubricants for powdered metals they gave results similar to those obtained with unepoxidized soyabean oil.

EXAMPLE XX

Effect of mixtures of zinc stearates and microcapsules from Example VIII on iron powder Blends of zinc stearate (from H. L. Blachford, Limited) and microcapsules from Example VIII were prepared and tested using Atomet 29 (trademark) from Quebec Metal Powder Company. The total concentration of lubricant was held constant at 1% by weight. Although, no maximum occurred in the plot for green density, a minimum occurred in the ejection force at approximately 60% microcapsule content, showing once again the existence of synergism.

EXAMPLE XXI

Epoxidized soyabean oil encapsulated in the reaction product from triethylenetetramine and polymethylene polyphenylisocyanate 19.6 g. of polymethylene polyphenylisocyanate (Mondur MRS, trademark, from Mobay Chemical Company), was dissolved in 75.0 g. of epoxidized soyabean oil (Plastolein 9232, trademark from Emery Industries, Inc.) together with 3.0 g. of a tallow fatty acid diester of polyethylene glycol of molecular weight 600. The solution was added with vigorous stirring to 700 ml. of water. When the emulsification was complete, the stirring rate was reduced and 10.0 g. of triethylenetetramine dissolved in 100 ml. of water was added. The mixture was heated to 80° C. for 2 hours with continued stirring, cooled, and filtered. The microcapsules were dried at 60° C. and disaggregated by sieving through a 60 mesh sieve. They were white, spherical, free-flowing, had an average diameter of about 70 microns, and contained about 75% by weight of oil.

EXAMPLE XXII

Testing of microcapsules prepared in Example XXI

The microcapsules of Example XXI were tested in the iron powders Atomet 28 (trademark, from Quebec Metal Powder Co.) and Atomet 29, and results were compared with those obtained for zinc stearate and ethylenebisstearamide wax. Lubricant and iron powder were thoroughly mixed and transverse rupture specimens pressed using a pressure of 67200 psi. The parts were subjected to lubricant burnoff at 1000° F. for 30 minutes in an atmosphere of hydrogennitrogen (50:50), followed by sintering at 2050° F. for 30 minutes. Properties were measured according to standard ASTM procedures and are shown in Table V.

TABLE V

Comparison of effects of standard lubricants and microcapsule lubricants in Atomet 28 and Atomet 29.

| METAL | ATOMET 28 1% LUBRICANT | | | ATOMET 29 0.75% LUBRICANT | | |
|---|---|---|---|---|---|---|
| LUBRICANT | ZINC STEARATE | EBS WAX | MICRO-CAPSULES | ZINC STEARATE | EBS WAX | MICRO-CAPSULES |
| Flow time (sec./50 g.) | 28.3 | 40.3 | 24.6 | 25.0 | 32.2 | 23.4 |
| Apparent density (g./cc.) | 3.24 | 2.97 | 2.83 | 3.34 | 3.08 | 3.02 |
| Ejection force (lb.) | 4640 | 4420 | 3980 | 5400 | 5370 | 4590 |
| Green density (g./cc.) | 6.69 | 6.71 | 6.67 | 6.73 | 6.73 | 6.71 |
| Green strength (p.s.i.) | 1620 | 1910 | 1480 | 1480 | 1770 | 1480 |
| Sintered density (g./cc.) | 6.68 | 6.71 | 6.71 | 6.73 | 6.73 | 6.74 |
| Sintered strength (p.s.i.) | 49700 | 51000 | 54900 | 54700 | 53600 | 54300 |
| Growth (%) | −0.24 | −0.28 | −0.29 | −0.10 | −0.20 | −0.23 |

The results in Table V show that, compared to zinc stearate and ethylenebisstearamide wax, the microcapsules of Example XXI give excellent flow, lower ejection, and comparable sintered density and sintered strength. Apparent density and green strength are slightly lower.

I claim:

1. Discrete pressure-rupturable microcapsules for lubrication in powder metallurgy comprising a core and a solid shell surrounding said core; said core comprising an organic liquid lubricant non-corrosive to ferrous metal, having a viscosity below 1500 cp and a surface tension below 50 dynes/cm and being able to wet powdered ferrous metal, said liquid lubricant comprising at least one fatty acid ester; said core comprising 50 to 85%, by weight, of the microcapsules; said shell being derived from the polymerization of a di- or poly-isocyanate with a di- or poly-amine, non-degradable by moisture or oxygen, impermeable to said lubricant and having a smooth, non-tacky, outer surface such that the flow rate and apparent density of a mixture of the microcapsules and powdered ferrous metal wherein the microcapsules are present in an amount in the range of 0.3 to 1%, by weight, are at least 90% of the corresponding values for the free powdered ferrous metal, said outer surface being resistant to abrasion by powdered ferrous metal to the extent that the microcapsules can be thoroughly mixed with sinterable powdered metal without release of lubricant, said shell being rupturable when said micro-capsules are in admixture with powdered ferrous metal at a pressure of 20 to 100 t.s.i.; said lubricant and said shell being heat decomposable or volatilizable to gaseous products, which are non-corrosive to powdered ferrous metal, with a low residue of carbon at elevated temperatures below the sintering temperature of the ferrous metal; said microcapsules being spherical and having a diameter in the range of 1 to 200 microns with a shell thickness of 0.01 to 50 microns.

2. Microcapsules according to claim 1, wherein said liquid lubricant comprises at least one synthetic fatty acid ester.

3. Microcapsules according to claim 1, wherein said shell is derived from the polymerization of a diisocyanate with a diamine.

4. Microcapsules according to claim 3, wherein said diamine is ethylene diamine or propylenediamine.

5. Microcapsules according to claim 4, wherein said diisocyanate is toluene diisocyanate or trimethyl hexamethylene diisocyanate.

6. A novel composition of matter for the manufacture of sintered iron articles comprising a sinterable mixture comprising powdered iron and discrete pressure-rupturable microcapsules for lubrication in powder metallurgy, said microcapsules being present in an amount of 0.1% to 5%, by weight, said microcapsules comprising a core and a solid shell surrounding said core; said core comprising an organic liquid lubricant non-corrosive to ferrous metal, having a viscosity below 1500 cp and a surface tension below 50 dynes/cm and being able to wet powdered ferrous metal; said core comprising 50 to 85%, by weight, of the microcapsules; said shell being derived from the polymerization of a di- or poly-isocyanate with a di- or polyamine, non-degradable by moisture or oxygen, impermeable to said lubricant and having a smooth, non-tacky, outer surface such that the flow rate and apparent density of said mixture of powdered iron and microcapsules are at least 90% of the corresponding values for the free powdered ferrous metal, said outer surface being resistant to abrasion by powdered ferrous metal to the extent that the microcapsules can be thoroughly mixed with sinterable powdered metal without release of lubricant, said shell being rupturable when said micro-capsules are in admixture with powdered ferrous metal at a pressure of 20 to 100 t.s.i.; said lubricant and said shell being heat decomposable or volatilizable to gaseous products, which are non-corrosive to powdered ferrous metal, with a low residue of carbon at elevated temperatures below the sintering temperature of the ferrous metal; said microcapsules being spherical and having a diameter in the range of 1 to 200 microns with a shell thickness of 0.01 to 50 microns.

7. A composition according to claim 6, wherein said powdered iron contains graphite as an additive.

8. A composition according to claim 6, wherein said mixture includes an unencapsulated solid particulate powder metallurgy lubricant.

9. A composition according to claim 8, wherein said mixture contains from 5 to 95%, by weight, of said microcapsules and from 95 to 5%, by weight, of said unencapsulated solid lubricant, based on the weight of microcapsules and unencapsulated solid lubricant.

10. A composition according to claim 9, wherein said unencapsulated solid lubricant is an amide wax.

11. A composition according to claim 10, wherein said amide wax is ethylenebisstearamide.

12. A composition according to claim 9, wherein said unencapsulated solid lubricant is a metal stearate.

13. A composition according to claim 12, wherein said metal stearate is zinc stearate.

14. A composition according to claim 6, wherein said organic liquid lubricant comprises at least one fatty acid ester.

15. A synergistic free flowing lubricant composition for powder metallurgy lubrication comprising discrete pressure-rupturable microcapsules in admixture with an unencapsulated solid particulate powder metallurgy lubricant; said microcapsules comprising a core and a solid shell surrounding said core; said core comprising an organic liquid lubricant non-corrosive to ferrous metal, having a viscosity below 1500 cp and a surface tension below 50 dynes/cm and being able to wet powdered ferrous metal, said liquid lubricant comprising at least one fatty acid ester; said core comprising 50 to 85%, by weight, of the microcapsules; said shell being derived from the polymerization of a di- or poly-isocyanate with a di- or polyamine, non-degradable by moisture or oxygen, impermeable to said lubricant and having a smooth, non-tacky, outer surface such that the flow rate and apparent density of a mixture of the microcapsules and powdered ferrous metal wherein the microcapsules are present in an amount in the range of 0.3 to 1%, by weight, are at least 90% of the corresponding values for the free powdered ferrous metal, said outer surface being resistant to abrasion by powdered ferrous metal to the extent that the microcapsules can be thoroughly mixed with sinterable powdered metal without release of lubricant, said shell being rupturable when said micro-capsules are in admixture with powdered ferrous metal at a pressure of 20 to 100 t.s.i.; said lubricant and said shell being heat decomposable or volatilizable to gaseous products, which are non-corrosive to powdered ferrous metal, with a low residue of carbon at elevated temperatures below the sintering temperature of the ferrous metal; said microcapsules being spherical and having a diameter in the range of 1 to 200 microns with a shell thickness of 0.01 to 50 microns.

16. A synergistic composition according to claim 15, wherein said unencapsulated solid particulate lubricant is an amide wax.

17. A composition according to claim 16, wherein said amide wax is ethylenebisstearamide.

18. A composition according to claim 15, wherein said unencapsulated solid particulate lubricant is a metal stearate.

19. A composition according to claim 18, wherein said metal stearate is zinc stearate.

20. A composition according to claim 15, comprising from 5 to 95%, by weight, of said microcapsules and from 95 to 5%, by weight, of said unencapsulated solid particulate powder metallurgy lubricant.

21. A composition according to claim 15, wherein said shell is derived from the polymerization of a diisocyanate with a diamine.

22. A composition according to claim 15, wherein said di- or poly-isocyanate is toluene diisocyanate, trimethyl hexamethylene diisocyanate or polymethylene polyphenylisocyanate.

23. A composition according to claim 22, wherein said di- or poly-amine is ethylene diamine, propylenediamine or triethylene-tetramine.

24. A composition according to claim 15, wherein said fatty acid ester is a synthetic fatty acid ester.

25. A novel composition of matter for the manufacture of a sintered metal article comprising a sinterable mixture comprising a powdered metal and microcapsules, said microcapsules being present in an amount of 0.1% to 5%, by weight, and comprising a core and a solid shell surrounding said core; said core comprising an organic liquid lubricant non-corrosive to ferrous metal, having a viscosity below 1500 cp and a surface tension below 50 dynes/cm and being able to wet powdered ferrous metal; said core comprising 50 to 85%, by weight, of the microcapsules; said shell being derived from the polymerization of a di- or poly-isocyanate with a di- or polyamine, non-degradable by moisture or oxygen, impermeable to said lubricant and having a smooth, non-tacky, outer surface such that the flow rate and apparent density of said mixture of powdered metal and microcapsules are at least 90% of the corresponding values for the free powdered ferrous metal, said outer surface being resistant to abrasion by powdered ferrous metal to the extent that the microcapsules can be thoroughly mixed with sinterable powdered metal without release of lubricant, said shell being rupturable when said micro-capsules are in admixture with powdered ferrous metal at a pressure of 20 to 100 t.s.i.; said lubricant and said shell being heat decomposable or volatilizable to gaseous products, which are non-corrosive to powdered ferrous metal, with a low residue of carbon at elevated temperatures below the sintering temperature of the ferrous metal; said microcapsules being spherical and having a diameter in the range of 1 to 200 microns with a shell thickness of 0.01 to 50 microns.

26. A composition according to claim 25, wherein said powdered metal is a powdered metal alloy.

27. A composition according to claim 25, wherein said powdered metal is a mixture of metal powders.

28. A composition according to claim 25, wherein said liquid organic lubricant comprises a fatty acid ester.

29. A composition according to claim 28, wherein said mixture includes an unencapsulated solid particulate powder metallurgy lubricant; said mixture containing from 5 to 95%, by weight, of said microcapsules and from 95 to 5%, by weight, of said unencapsulated solid lubricant, based on the weight of microcapsules and unencapsulated solid lubricant.

30. A composition according to claim 29, wherein said unencapsulated solid lubricant is an amide wax.

31. A composition according to claim 29, wherein said unencapsulated solid lubricant is a metal stearate.

* * * * *